US005931711A

United States Patent [19]

Nakamura

[11] Patent Number: 5,931,711

[45] Date of Patent: Aug. 3, 1999

[54] OUTBOARD ENGINE COMPONENT MOUNTING

[75] Inventor: Daisuke Nakamura, Hamamatsu, Japan

[73] Assignee: Sanshin Kogyo Kabushiki Kaisha, Hamamatsu, Japan

[21] Appl. No.: 08/947,974

[22] Filed: Oct. 9, 1997

[30] Foreign Application Priority Data

Oct. 9, 1996 [JP] Japan ..... 8-285845

[51] Int. Cl.[6] ..... B63H 20/32

[52] U.S. Cl. ..... 440/78; 440/52

[58] Field of Search ..... 440/88, 89, 76–78

[56] References Cited

U.S. PATENT DOCUMENTS 4,723,926 2/1988 Uehara ..... 440/76

*Primary Examiner*—Jesus D. Sotelo

*Attorney, Agent, or Firm*—Knobbe, Martens, OLson & Bear LLP

[57] ABSTRACT

An outboard motor incorporating a mounting assembly for resiliently connecting the steering shaft to the driveshaft housing. The mounting assembly also includes locating an attachment bracket on the driveshaft housing juxtaposed to a box shaped section of the internal cavity of the driveshaft housing.

6 Claims, 5 Drawing Sheets

OUTBOARD ENGINE COMPONENT MOUNTING

BACKGROUND OF THE INVENTION

This invention relates to a mounting arrangement for an outboard motor and more particularly to a structure for mounting the lower bracket of the steering shaft to the drive shaft housing.

Most conventional outboard motor constructions employ a clamping bracket that is adapted to be affixed in a suitable manner to the hull of the associated watercraft and which pivotally supports a swivel bracket for tilt and trim movements. The swivel bracket, in turn, journals a steering shaft for steering movement about a generally vertically extending steering axis when the swivel bracket is tilted down. The steering shaft, in turn, is resiliently connected to the driveshaft housing so as to support the remaining components of the outboard motor on the clamping bracket. The resilient support is employed for reducing the transmission of vibration from the operation of the propulsion unit, including the powering internal combustion engine, to the hull.

Normally the driveshaft housing is a generally open casing made from a lightweight material such as aluminum or aluminum allow casting. The driveshaft housing is generally open at the top and the power head, including the powering internal combustion engine, is carried at the upper end of the driveshaft housing. The internal cavity of the driveshaft housing defmes several chambers. Two such chambers of the internal cavity are an exhaust expansion chamber and a water pump chamber containing water for the cooling of the engine.

Conventionally the structure for attaching the lower end of the steering shaft to the driveshaft housing has been comprised of an attaching bracket comprised of two bracket members capturing a resilient member that engages a portion of the driveshaft housing at a lower end. Typically, the attaching bracket is mounted on the driveshaft housing at a location corresponding to the an internal portion of the driveshaft housing juxtaposed to the expansion chamber. Further, the attachment mechanism has typically been attached to the driveshaft housing at a point where only the two exterior wall of the driveshaft housing provide reaction support for the attachment bracket.

It is, therefor, a principal object of the this invention to provide an improvement to the rigidity of the driveshaft housing in the region of the lower attachment bracket of the steering shaft.

It is a further object of this invention to provide a mounting arrangement for the steering shaft of an outboard motor to the driveshaft housing that will allow a cooling supply to the mounting arrangement.

It is a further object of the this invention to provide an improved mounting arrangement that minimizes the number of parts and the number of detachable connections.

SUMMARY OF THE INVENTION

This invention is to be adapted to an outboard motor comprised of a power head including an internal combustion engine and surrounding protective cowling. The motor also includes a drive shaft housing and lower unit depending from said engine. A drive shaft is journaled within the drive shaft housing and lower unit and is driven by the engine. A propulsion device is located at the lower end of said drive shaft housing and lower unit and is driven by the drive shaft for propelling an associated watercraft. The drive shaft housing is comprised of an outer shell defining a generally vertically extending internal cavity. A box shaped section, formed by said drive shaft housing and lower unit at a lower portion thereof by vertically extending front and rear walls joined integrally by vertically extending side walls and passes the said drive shaft. The vertically extending rear wall terminates short of the upper end of the drive shaft housing and lower unit within said internal cavity. A steering shaft is disposed forwardly of the front wall. There are also means for connecting the steering shaft to the drive shaft housing and lower unit in proximity to the box shaped section and through cooperation therewith comprised of an attaching bracket at least partially encircling and engaging said box shaped section in juxtaposition to the vertically extending rear wall.

DETAILED DESCRIPTION OF THE PREFERRED EMBODIMENTS OF THE INVENTION

Figure 1:
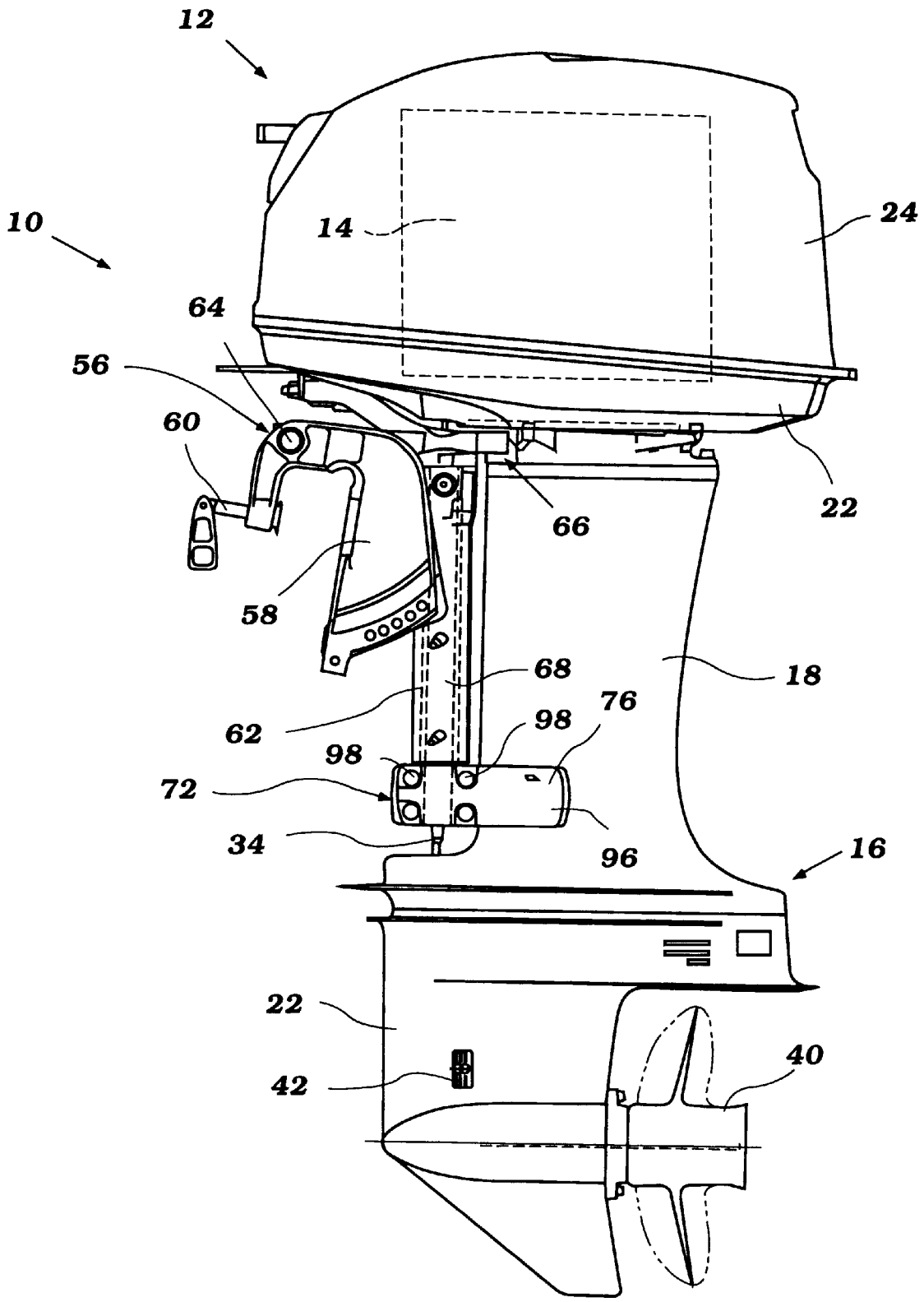
FIG. 1 is a side elevational view an outboard motor constructed in accordance with the invention.

Referring first to FIG. 1, an outboard motor constructed in accordance with this embodiment of the invention is identified generally by the reference numeral 10. The outboard motor is comprised of a power head indicated generally by the reference numeral 12, which is comprised of an internal combustion engine 14, shown in rectangular dashed format, and is mounted to the upper end of a driveshaft housing and lower unit 16. The driveshaft housing and lower unit can be formed integrally or as a two separate parts. The preferred embodiment shows the driveshaft housing 18 as being separate from the lower unit 20. Typically the driveshaft housing 18 is formed as a casting from a lightweight material such as aluminum or an aluminum alloy. The lower unit 20 is provided at the lower end of the driveshaft housing 18.

The engine 14 may be of any known type and may be of the inline, two or three cylinder, or two cycle crankcase compression type. The details of the engine, such as the cylinder block, pistons and exhaust manifold are not shown in FIG. 1. This engine 14 is supported on a lower tray assembly which forms a portion of the protective cowling that encircles and protects the engine 14. The cowling is completed by an upper cowling member 24 which is detachably affixed to the tray 22 in a known manner.

Figure 2:
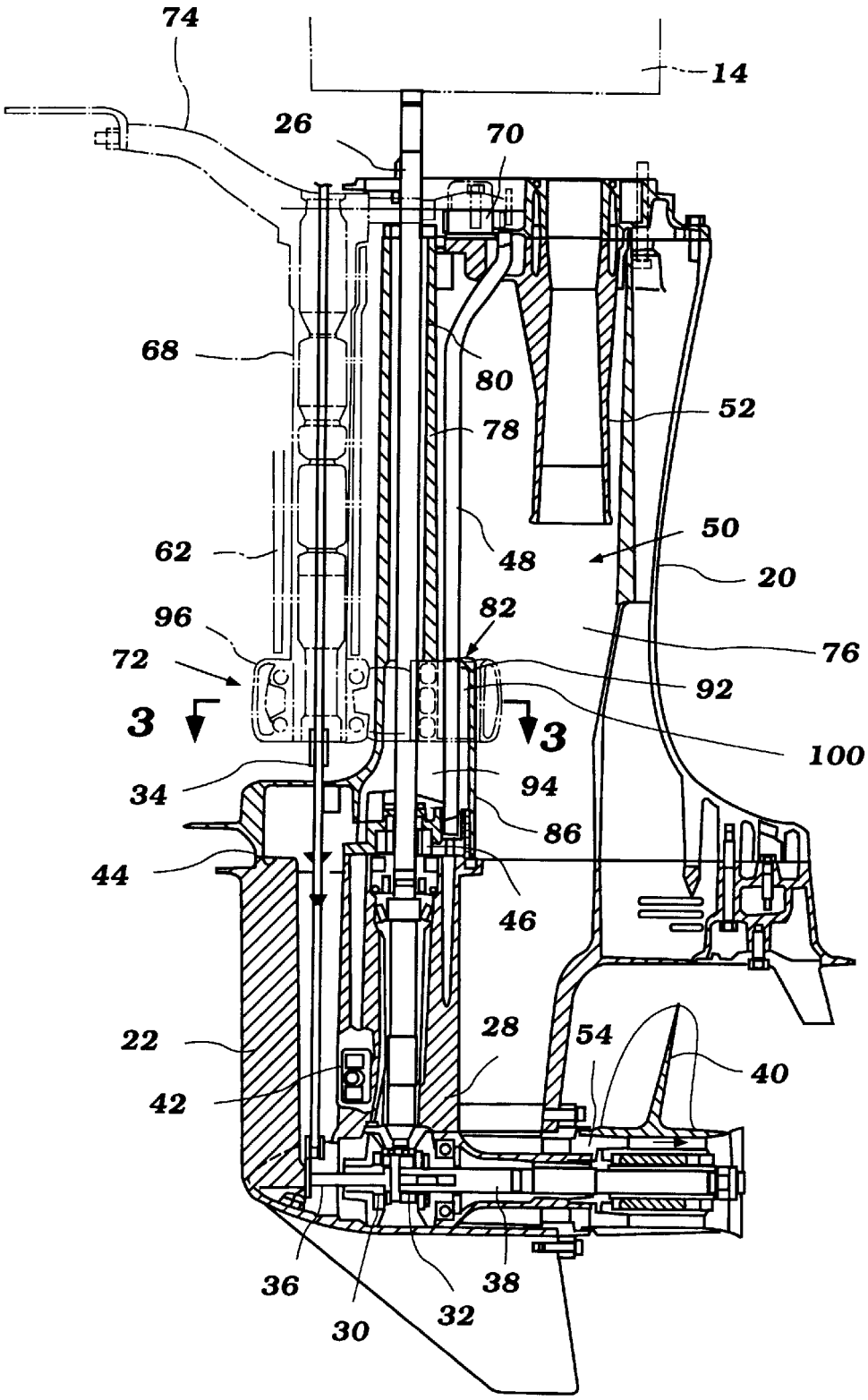
FIG. 2 is a enlarged cross sectional view of the drive shaft housing and lower unit of FIG. 1 with some portions shown in section.

The engine 14 is supported in the power head 12 so that its output shaft rotates about a generally vertically extending axis. The output shaft, not shown, is coupled in a known manner to a drive shaft 26 that depends through the driveshaft housing 18 and into lower unit 20 as best shown in FIG. 2. The driveshaft 26 is journaled in any suitable manner. At its lower end, the driveshaft 26 is coupled to a forward neutral reverse transmission. The drive shaft terminates at a bevel gear 28 that drives passive bevel gears 30 and 32 in a known manner.

The transmission, of which the details are not shown, is controlled by a shift rod 34 which is journaled for rotatable support in the lower unit 32. The shift rod is connected to a shift cam 36 for actuation of the transmission in a known manner. The transmission couples the drive shaft 26 to a propeller shaft 38 on which a propeller 40 is affixed in a known manner. The preferred embodiment illustrates an outboard motor with a propeller shaft and a conventional propeller. Nevertheless, any propulsion device could be utilized with the present invention.

The engine 14 is water-cooled and the water for its cooling system is drawn from the body of water in which the outboard motor 10 is operating. The cooling water is admitted through either water inlet opening 42 or 44 both of which are formed in the lower unit 20. A water pump 46 is mounted at the interface between the driveshaft housing 18 and the lower unit 20 and is driven by the driveshaft 26 in a known manner. The water pump 46 draws water through the inlet 42 and delivers it upwardly to the engine 14 through a water supply conduit 48. Further details of this supply conduit will be described by reference to the remaining figures.

The engine 14 discharges its exhaust gases down into a silencing arrangement provided within an internal cavity 50 in the driveshaft housing through an exhaust pipe 52 as best seen in FIG. 2. The exhaust pipe extends into an expansion chamber formed at the rear of the driveshaft housing. The expansion chamber terminates at its lower end in an exhaust gas discharge 54 formed in the lower unit 20 for delivering the exhaust gases to the atmosphere back through the body of water in which the associated watercraft is operating. A conventional through the propeller hub exhaust gas discharge may be provided for this purpose. Although the preferred embodiment illustrates an exhaust passage through the hub any type of conventional above-the-water exhaust gas discharge may be used with the present invention.

Continuing to refer to FIG. 1., the outboard motor 10 also includes a clamping bracket, indicated generally by the reference numeral 56, which has a transom portion 58 that is adapted to engage the rear of the transom of an associated watercraft. A clamping device 60 is also carried by the clamping bracket 56 and cooperates to affix the clamping bracket 56 to the transom in a well known manner.

A swivel bracket 62 is affixed for pivotal movement with respect to the clamping bracket 56 by means of a horizontally extending pivot pin 64. The pivotal connection permits tilt and trim movement of the outboard drive 10 relative to the hull of the associated watercraft, as is well known in the art. The components of the outboard motor which have been described of the power head 12, driveshaft housing 18 and lower unit 20 are connected to the swivel bracket 62 by means of a steering arrangement, indicated generally as 66. The steering arrangement 66 includes a steering shaft 68 which appears in dashed line in FIG. 1, is connected to the driveshaft housing 18 and specifically its outer casing by an upper resilient attachment mechanism and a lower resilient attachment bracket 72. The location of the attachment bracket 72 on the driveshaft housing 18 embodies the invention.

The steering shaft 68 and the steering arrangement 66 includes a tiller 74 that is affixed to the upper end of the steering shaft 68 in a well known manner and is illustrated in FIG. 2. A steering handle, not shown, which may contain other controls for the outboard motor 10, is connected to the tiller 74 in a known manner. The structure of the outboard motor as thus far described may be considered to be conventional.

Referring now to the remaining figures, the connection between the steering shaft 68, the swivel bracket 62, and the driveshaft housing 18 will be described. Referring first to FIG. 2, the driveshaft housing 18 defines an internal cavity 50. The internal cavity consists primarily of an exhaust expansion chamber 76 communicating with the exhaust portion of engine 10.

The forward most portion of the exhaust expansion chamber 76 is defined by a generally tubular member 78. The tubular member 78 is formed integrally with the driveshaft housing 18 and defines a cavity 80 in which the driveshaft 26 rotates. As best illustrated in FIG. 2 the tubular member extends to the upper portion of the driveshaft housing 18 and down to a generally box shaped section 82.

Figure 3:
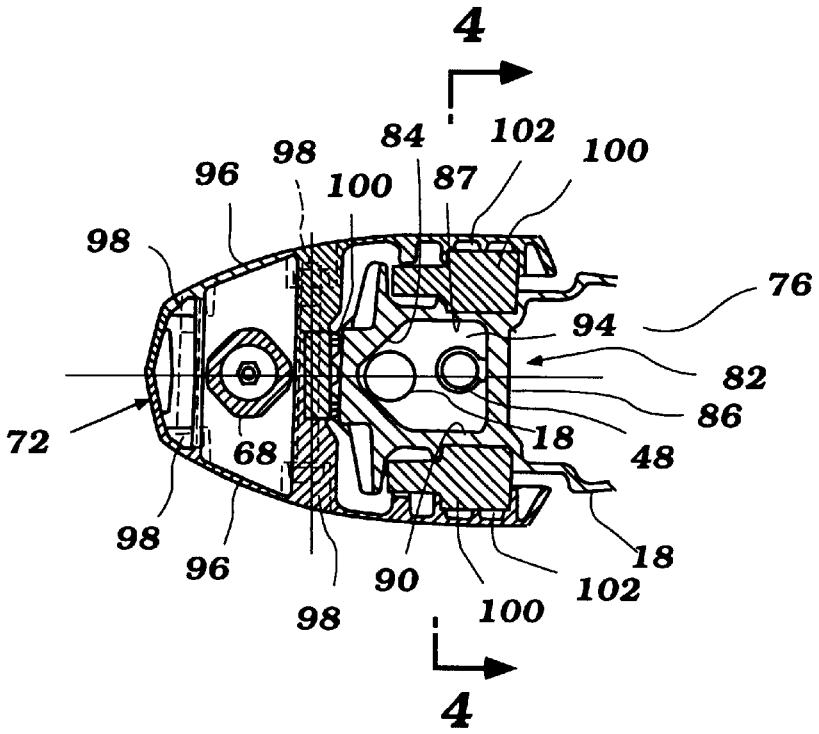
FIG. 3 is a partial cross section of FIG. 2 taken along line 3—3.

The box shaped section is comprised of a vertically extending front wall 84 and a vertically extending rear wall 86 both formed integrally with the walls of the driveshaft housing 18 as best illustrated in FIG. 3. The front and rear walls are joined integrally by vertically extending side walls 88 and 90 also shown in FIG. 2. The rear wall 86 stopping short of the upper end of the drive shaft housing 18. The box shaped section 82 only extends partially up the driveshaft housing 18 and terminates at a position juxtaposed to the top of the attaching bracket 72. The box shape adds rigidity to the drive shaft housing and provides for improved support for the attaching bracket 72. The box shaped section is closed out by a substantially horizontal top plate 92. The top plate has an opening to pass the water inlet conduit 48.

The box shaped section 82 defines an inner chamber 94 through which both the driveshaft 26 and the water supply conduit 48 pass. The water pump 46 is located in the bottom portion of the box shaped section 82 and during normal operation the inner chamber 94 is filled with water. The water keeps the wall of the box shaped section cool as compared with the walls contacting the expansion chamber 76.

Figure 4:
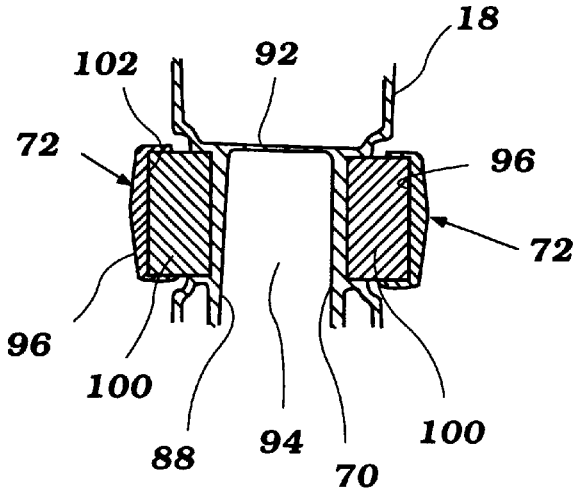
FIG. 4 is a partial cross section of FIG. 3 taken along line 4—4.

As best illustrated in FIG. 3 and FIG. 4 the attachment bracket 72 partially encircles the box shaped section 82. The attachment bracket 72 comprises two mating generally arcuate brackets 96. The brackets 96 are fastened together with a plurality of mechanical fasteners 98 as know in the art. The brackets 96 capture a resilient member 100 which engages the box shaped section 82. The resilient mount 100 is typically constructed from a rubber material to provide support and vibrational damping. Further, the mount 100 is trapped within the internal portion 102 of the brackets 96 to prevent shifting of the mounts. As best illustrated in FIG. 3 the resilient mounts extend along the side walls 88 and 90 of the box shaped section 82 thus the water in the chamber 94 cools the walls of the chamber 94 and thus cools the mounts 100.

The location of the attaching bracket on the exterior of the driveshaft housing 18 is best illustrated in FIG. 2. As shown the top of the attaching bracket 72 is juxtaposed with top plate 92. In this configuration the rigidity of the hollow internal cavity 50 is greatly improved thus enhancing the effectiveness of the mount attaching bracket 72.

Figure 5:
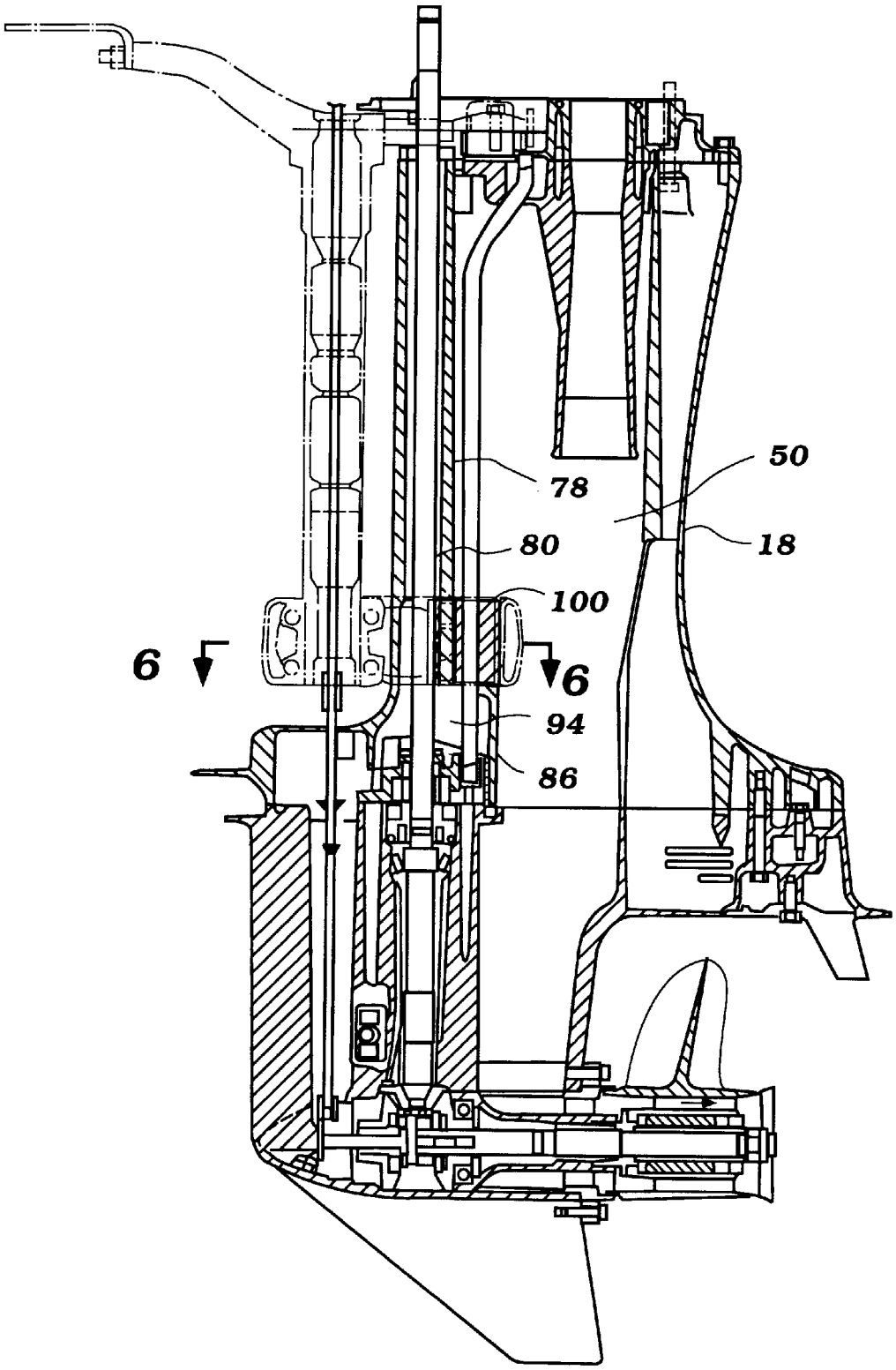
Figure 5 Prior Art
FIG. 5 is an enlarged cross section of the prior art.
Figure 6:
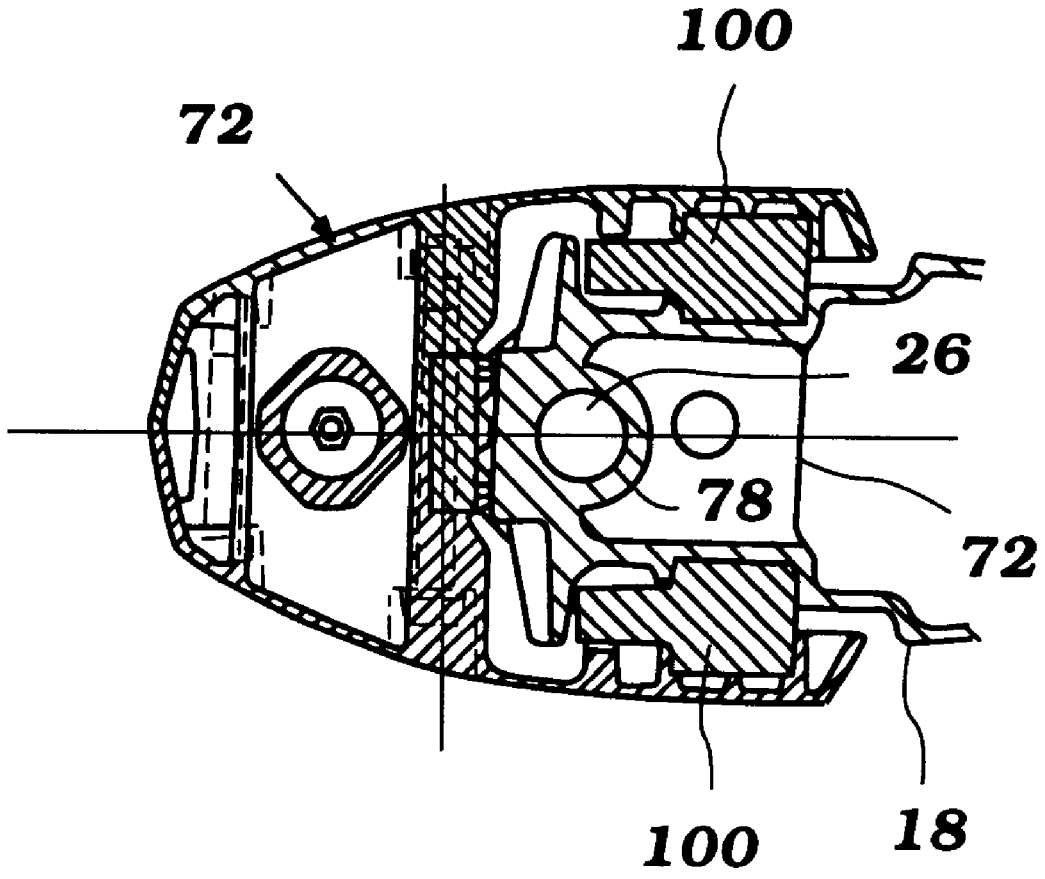
Figure 6 Prior Art
FIG. 6 is a cross section of FIG. 5 taken along line 6—6.

FIG. 5 and FIG. 6 illustrate the prior art for the present invention. The reference numerals are the same as previously described in the proceeding drawings. As illustrated best in FIG. 5 the rear wall 86 of the chamber 94 extends only to the bottom edge of the attaching bracket 72. By mounting the attaching bracket 72 in this location it can only react against the non-reinforced side walls of the driveshaft housing 18. As stated earlier, the drive shaft housing is typically constructed of an aluminum or an aluminum alloy and therefor is typically brittle. Another problem associated with locating the attaching bracket 72 in the location of the prior art is that resilient mounts 100 will contact the same walls as the exhaust chamber as best shown in FIG. 6. In this type of configuration, during normal operation the exhaust expansion chamber typically is heated by the exhaust of the engine 10. This in turn heats the internal walls abutting the mount 100 thereby degrading the material.

Of course, the foregoing description is that of preferred embodiments of the invention, and various changes and modifications may be made without departing from the spirit and scope of the invention, as defined by the appended claims.

What is claimed is:

1. An outboard motor comprised of a power head including an internal combustion engine and surrounding protective cowling, a drive shaft housing and lower unit depending from said engine, a drive shaft journaled within said drive shaft housing and lower unit and driven by said engine, a propulsion device at the lower end of said drive shaft housing and lower unit and driven by said drive shaft for propelling an associated watercraft, said drive shaft housing being comprised of an outer shell defining a generally vertically extending internal cavity, a box shaped section, formed by said drive shaft housing and lower unit at a lower portion thereof by vertically extending front and rear walls joined integrally by vertically extending side walls and passing said drive shaft, said vertically extending rear wall terminating short of the upper end of said drive shaft housing and lower unit within said internal cavity, a steering shaft disposed forwardly of said front wall, and means for connecting said steering shaft to said drive shaft housing and lower unit in proximity to said box shaped section and through cooperation therewith comprised of an attaching bracket at least partially encircling and engaging said box shaped section in juxtaposition to said vertically extending rear wall.

2. An outboard motor of claim 1 including a generally tubular wall extending from said box member encasing said drive shaft wherein said upper end of said box member is lower than an upper end of said tubular wall.

3. An outboard motor of claim 1 wherein said engine is a water cooled engine including a water pump means for supplying water to said engine, said pump being located within said box structure and driven by said drive shaft.

4. An outboard motor of claim 3 wherein said water pump communicates with a water supply tube passing through said box section and communicating to said engine cooling system.

5. An outboard motor of claim 1 wherein said engaging portion of said attaching bracket is constructed of a resilient material.

6. An outboard motor of claim 5 wherein said resilient material extends along side walls of said box shaped section from said front wall to said rear wall.

* * * * *